United States Patent [19]

Weir

[11] Patent Number: 4,531,393

[45] Date of Patent: Jul. 30, 1985

[54] ELECTROMAGNETIC FORMING APPARATUS

[75] Inventor: Donald B. Weir, San Diego, Calif.

[73] Assignee: Maxwell Laboratories, Inc., San Diego, Calif.

[21] Appl. No.: 540,795

[22] Filed: Oct. 11, 1983

[51] Int. Cl.[3] ..... B21D 26/14

[52] U.S. Cl. ..... 72/56; 29/421 E; 72/707

[58] Field of Search ..... 72/56, 707; 29/421 E

[56] References Cited

U.S. PATENT DOCUMENTS

| | | | |
|---|---|---|---|
| 3,108,325 | 10/1963 | Harvey et al. . | |
| 3,195,335 | 7/1965 | Brower et al. . | |
| 3,321,946 | 5/1967 | Ferguson . | |
| 3,347,074 | 10/1967 | Eilers et al. | 72/56 |
| 3,391,558 | 7/1968 | Deeg . | |
| 3,423,978 | 1/1969 | Kline | 72/56 |
| 3,486,356 | 12/1969 | Brower et al. . | |
| 3,507,034 | 4/1970 | Schwinghamer et al. . | |
| 3,602,023 | 8/1971 | Furth . | |
| 3,654,787 | 4/1972 | Brower . | |
| 3,810,373 | 5/1974 | Queyroix | 72/56 |

*Primary Examiner*—Leon Gilden

*Attorney, Agent, or Firm*—Fitch, Even, Tabin & Flannery

[57] ABSTRACT

An electromagnetic forming apparatus having an expandable electromagnetic forming coil supported within an associated clamping press and having a pulse power system continuously operatively associated therewith to facilitate magnetic forming or swaging of conductive work pieces together. The forming coil employs a pair of conductive shaper halves conductively connected together in a single turn coil, the shaper halves being supported for relative movement therebetween while maintained in substantially parallel relation. The shaper halves have mutually cooperating forming recesses which receive the work pieces when the shaper halves are in open position and which define electromagnetic forming areas to swage the work pieces together when the shaper halves are closed and subjected to one or more power pulses. The apparatus finds particular application in electromagnetic forming of work pieces having enlarged or irregular cross-sections which prevent longitudinal insertion into or removal from fixed coils or shapers.

5 Claims, 9 Drawing Figures

10
12
14
18
20
22a
22b
24
26
26a
30
36a
38
40
40a
42a
42b
44
48
48b
50
50a
52a
56a
56b
56c
58
58a
58b
58c
90a
90b
100
102
104
106a
106b
106c
108a
108b
110
118a
118b 3
3
4
4
18
20
22a
22b
26a
30
34a
36a
38
44
48
50
50a
50b
52
52a
52b
56
56a
56b
56c
58
58a
58b
60c
60d
76a
76b
78a
78b
80a
80b
82a
82b
84a
84b
90a
94a
94b
96b
98a
100
104
106a
106b
108a
108b
110
112
114
116
118a
118b 10
18
22b
34a
34b
36a
36b
38
44
58
58a
58b
60a
60b
60c
60d
68a
68b
70a
70b
72
72b
76b
80b
100
104
106a
108a
108b
118a
120
122
124
124a
124b
124c
124d
126
126a
126b
126c
126d
128
130a
130b
132b
138
138a
138b
138d
140
140a
140b
140d
142a
142b
144
146a
146b

ELECTROMAGNETIC FORMING APPARATUS

BACKGROUND OF THE INVENTION

The present invention relates generally to forming apparatus, and more particularly to apparatus for electromagnetically forming or swaging cooperating portions of conductive work pieces by magnetic pulse means so as to connect the work pieces together.

Various methods and apparatus are known for forming or swaging conductive materials through the use of electromagnetic pulses. Conventionally, such apparatus establishes a magnetic field of sufficently high intensity and duration to create a high amperage electical current pulse which when passed through a conductor in the form of a coil creates a pulse magnetic field of high intensity in the proximity of one or more selectively positioned conductive work pieces. A current pulse is thereby induced in the work pieces which interacts with the magnetic field to produce a force acting on the work pieces. In the case of connecting telescoped portions of conductive work pieces, this force or magnetic pressure is made of sufficient magnitude to cause a desired deformation of the cooperating work pieces so that one piece is swaged to the other, the manner of deformation being generally dependent upon the shape or configuration of the magnetic field and the position of the work pices relative to the field.

The known apparatus for electromagnetic forming or swaging two work pieces into fixed relation typically employs a coil operative to surround the portions of the conductive work pieces to be formed or swaged. Many electromagnetic forming operations make use of solenoid compression coils in conjunction with shapers to concentrate the electromagnetic field pressure in the work area. When using such a forming coil with certain types or shapes of work pieces, a problem frequently arises in the ability of the work pieces to be inserted within the coil aperture defining the forming area or in withdrawal of the connected work pieces from the coil aperture. This is a particular problem when the work piece or assembly being formed has an enlarged or irregular configuration or has flanged ends which make it difficult, if not impossible, to insert or pass the work piece through a generally circular coil aperture by axial movement of the work piece. For example, one configuration which does not lend itself to removal from conventional forming coil apertures by axial movement of the formed work piece is a ring or circular shape. To alleviate this problem, electromagnetic forming apparatus have been developed which employ coil halves formed of conductive material and so arranged as by hinging, to be moveable between open positions enabling an irregular shaped work piece to be placed between the coil halves after which they are closed to provide a current path around the work piece. While the electrical efficiency of such hinged coil or shaper arrangements has been generally adequate, they do not lend themselves to high production rates in that the moveable one of the coil or shaper halves must generally be disconnected from the pulse power circuit during movement to enable insertion and removal of the work piece.

SUMMARY OF THE INVENTION

One of the primary objects of the present invention is to provide a novel electromagnetic forming apparatus employing a novel expandable conductive forming coil which enables insertion and withdrawal of generally enlarged or irregular shaped work pieces without having to disconnect the forming coil from its pulse power circuit.

A more particular object of the present invention is to provide a novel electromagnetic forming apparatus employing an electromagnetic forming coil comprised of two conductive shaper halves connected together into a single turn coil by conductors, the shaper halves also being connected in a pulse power circuit and being moveable between relatively open and closed positions to facilitate insertion and withdrawal of work pieces having enlarged or irregular cross section while the shaper halves are continuously connected to the pulse power circuit.

Further objects and advantages of the invention, together with the organization and manner of operation thereof, will become apparent from the following detailed description of the invention when taken in conjunction with the accompanying drawings wherein like reference numberals designate like elements throughout the several views.

DESCRIPTION OF PREFERRED EMBODIMENTS

Figures 1, 4, 7:
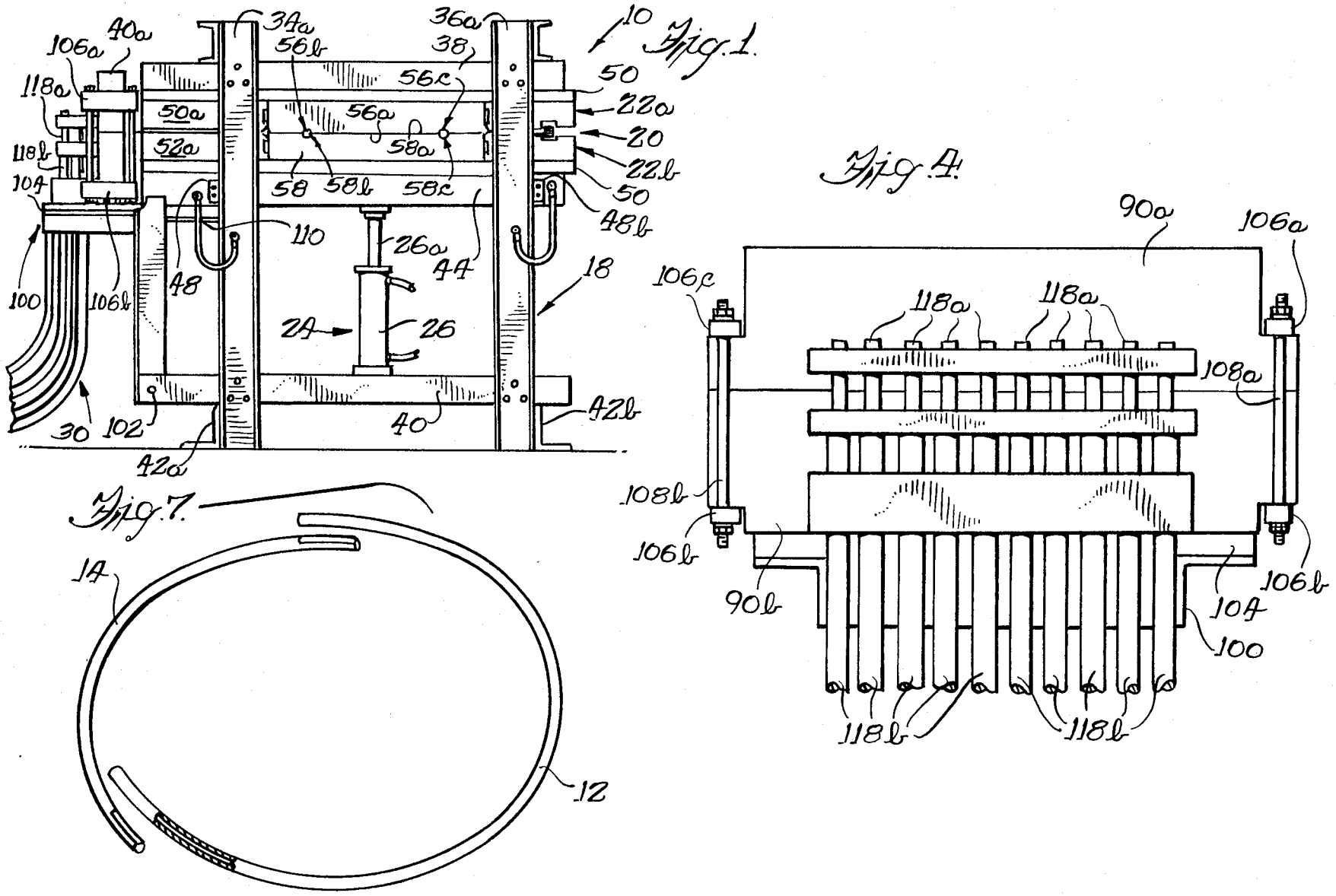
FIG. 1 is a perspective view of an electromagnetic forming apparatus employing an expandable coil in accordance with the present invention.
FIG. 4 is a fragmentary end view taken substantially alone line 4—4 of FIG. 2, looking in the direction of the arrows.
FIG. 7 is a perspective view of generally semi-circular work pieces which are adapted to be connected into a circular ring shape member in accordance with the appartus illustrated in FIG. 1.

Referring now to the drawings, and in particular to FIG. 1, apparatus in accordance with the present invention for electromagnetically forming a metallic work piece is indicated generally at 10. The electromagnetic forming apparatus 10, which may hereinafter be referred to as the forming apparatus, is particularly adapted for electromagnetic forming or swaging end portions of a first electically conductive generally semi-circular tubular work piece, such as indicated at 12 in FIG. 7, and portions of a second electically conductive generally semi-circular work piece, such as indicated at 14, which may be of either solid or tubular cross section and which has its end portions adapted to be inserted generally concentrically into the opposite ends of the work piece 12 in telescoping relation therewith. When the two work pieces 12 and 14 have their mutually opposite end portions connected by electromagnetic forming or swaging, the resulting composite work piece is of irregular configuration in the sense that it does not have a substantially straight longitudinal axis as would enable it to be inserted axially or longitudinally into and removed from a forming aperture in an electromagnetic forming coil of conventional design. As will become more apparent hereinbelow, other configurations of conductive work pieces which it is desired to join together by electromagnetic forming or swaging and which have enlarged or irregular cross sections preventing their axial insertion into or removal from fixed electromagnetic forming coils or shapers may also be electromagnetically formed with the forming apparatus 10.

Very generally, the electromagnetic forming apparatus 10 includes frame means, indicated generally at 18, which is operative to support an electromagnetic forming coil assembly, indicated generally at 20, in a manner to enable operator controlled movement between upper and lower forming or shaper assemblies, indicated at 22*a* and 22*b*, respectively. In the illustrated embodiment, the upper forming or shaper assembly 22*a* is supported in fixed substantially horizontal relation on the frame means 18 while the lower forming or shaper assembly 22*b* is supported by the frame means 18 in a manner to enable relative movement of the upper and lower shaper assemblies 22*a,b* between open and closed positions while being maintained in parallel relation. Such relative movement between the shaper assembliies is effected by actuator means, indicated generally at 24, which in the illustrated embodiment comprises a double acting fluid pressure cylinder 26 having an extendable piston rod 26*a* cooperative with the lower shaper assembly 22*b* so as to enable selective movement thereof relative to the upper shaper assembly 22*a*.

As will be described in greater detail hereinbelow, the two shaper assemblies 22*a* and 22*b* are electically interconnected in single turn coil by first conductor means, and are also connected through second conductor means to a pulse power supply, indicated generally at 30, such that the two shaper assemblies are continously connected to the pulse power supply. In this manner, application of a high amperage current pulse to the shaper assemblies 22*a,b* causes current flow through conductive shaper halves, to be described, and creates a high intensity magnetic field sufficient to form or swage electrically conductive work pieces which are selectively positioned between the shaper halves.

Turning now to a more detailed description of the electromagnetic forming apparatus 10, the frame means 18 includes two pairs of upstanding channel frame members 34*a,b* and 36*a,b* which are fixed to and maintained in substantially parallel spaced relation by upper and lower horizontal beam frame members 38 and 40, respectively, disposed transverse to frame members 34*a,b* and 36*a,b*. A pair of transverse angles 42*a* and 42*b* are preferably affixed to the lower ends of the upstanding frame members 34*a,b* and 36*a,b* to add stability to the frame structure.

The upper horizontal beam frame member 38 serves to support the upper shaper assembly 22*a*. A third or intermediate beam frame member 44 is supported between the upstanding frame members 34*a,b* and 36*a,b* so as to underlie the upper frame member 38 in substantially parallel relation thereto. Frame member 44 is affixed to the upper end of the actuating piston rod 26*a* in a manner to enable movement of the intermediate frame member relative to the upper frame member 38 while being maintained in substantially parallel relation therewith. The intermediate frame member 44 has laterally outwardly extending guide blocks on opposite sides thereof, two of which are indicated at 48*a* and 48*b* in FIG. 1, which cooperate with the corresponding upstanding frame members 34*a,b* and 36*a,b* to assist in maintaining the frame member 44 in parallel relation to frame member 38.

Figures 2, 5, 6:
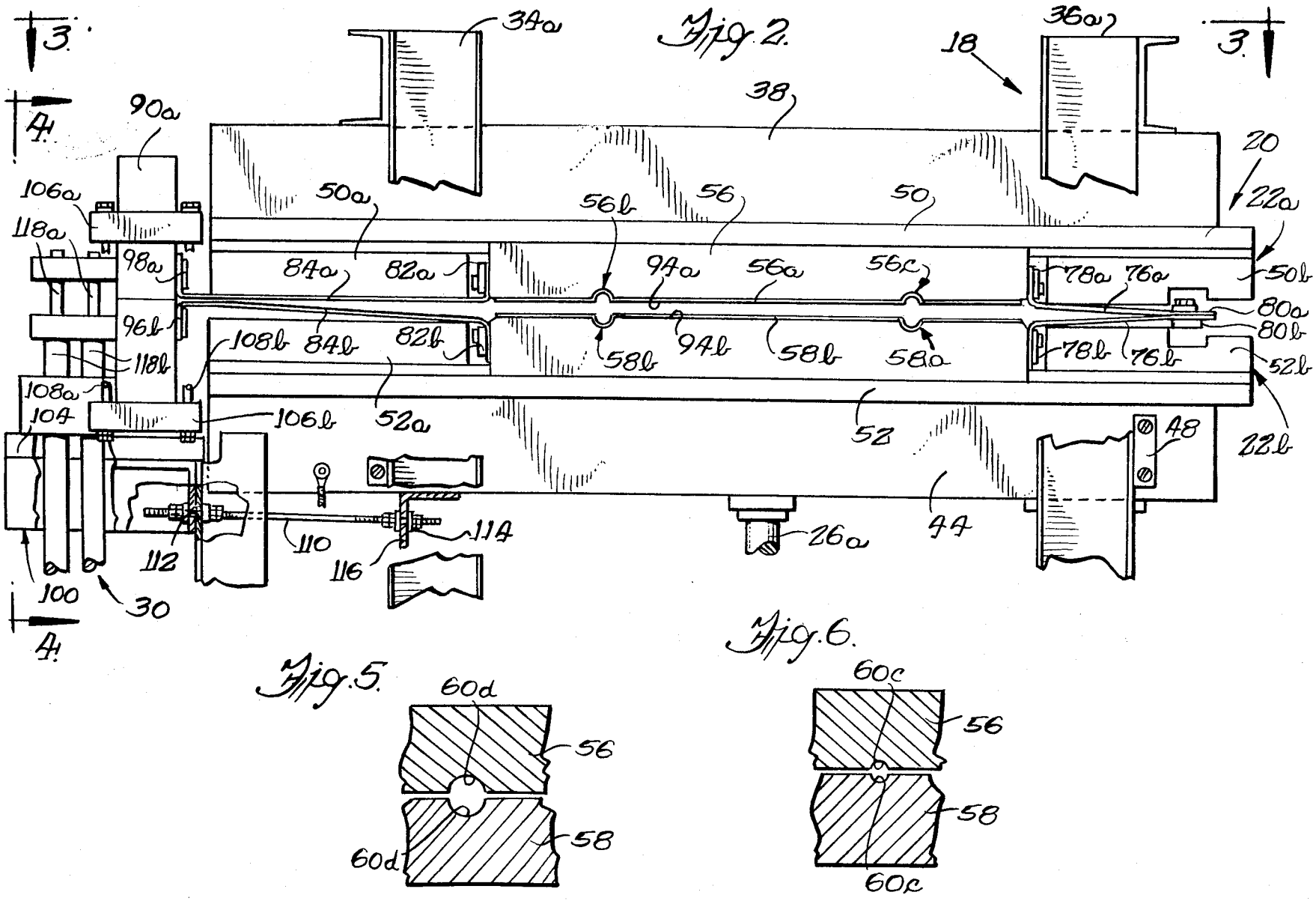
FIG. 2 is an enlarged fragmentary front view of the expandable coil portion of the apparatus of FIG. 1 with the shaper halves being shown in open spaced relation.
FIG. 5 is a fragmentary sectional view taken substantially along line 5—5 of FIG. 4.
FIG. 6 is a fragmentary sectional view taken substantially along line 6—6 of FIG. 4.
Figures 3, 8, 9:
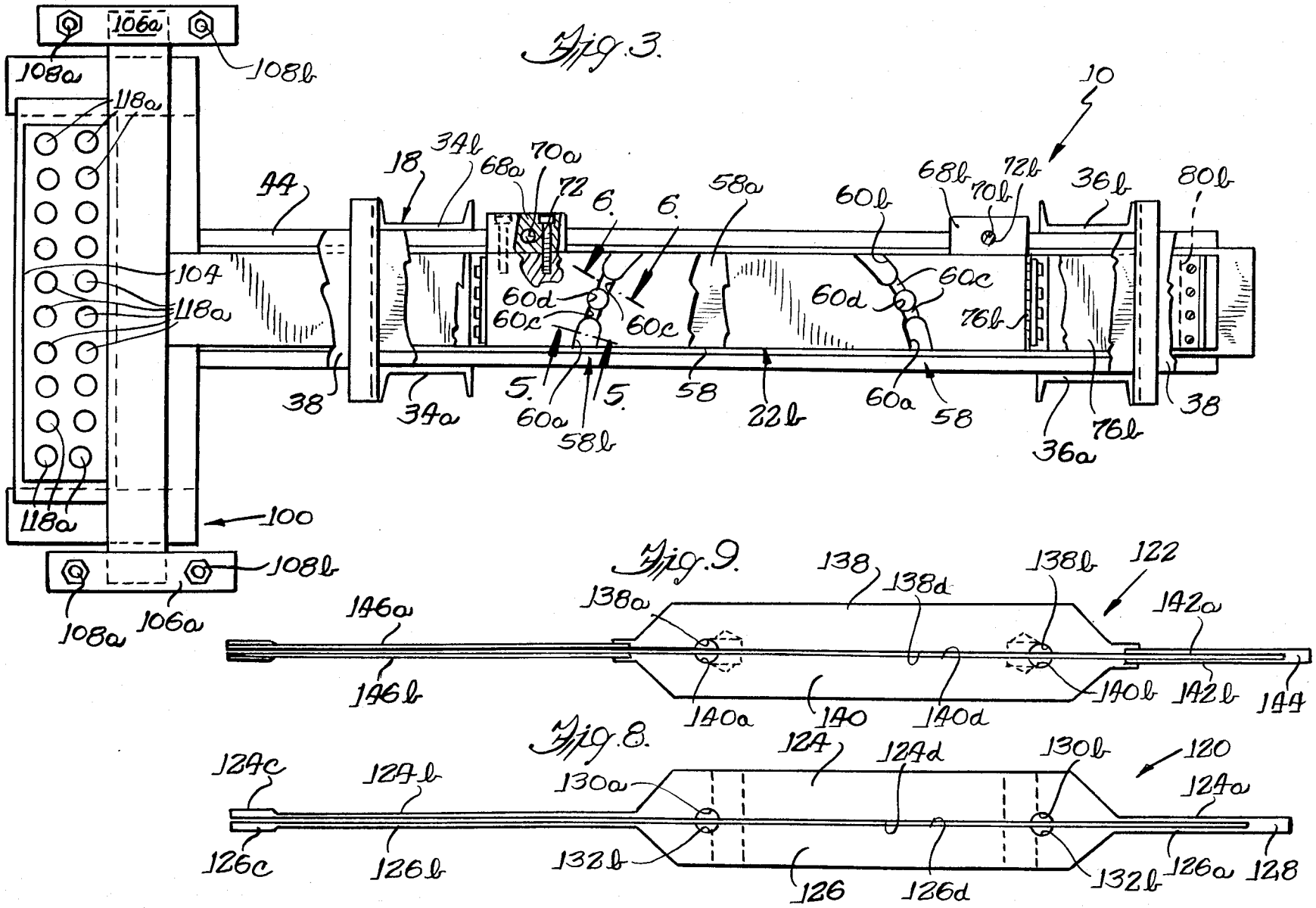
FIG. 3 is a fragmentary plan view of the shaper assembly illustrated in FIG. 2, taken substantially along line 3—3 of FIG. 2, but with portions broken away for clarity.
FIGS. 8 and 9 illustrate alternative shaper coils which may b employed in the apparatus of FIG. 1.

Referring to FIGS. 2 and 3, taken with FIGS. 5 and 6, the forming or shaper assemblies 22*a* and 22*b* are substantially identical in construction and each includes a coil insulator comprised of an insulator plate, indicated at 50 and 52, respectively, having generally rectangular insulator blocks secured to its opposite ends as indicated at 50*a,b* and 52*a,b*, respectively. The insulator plates 50 and 52 and their associated insulator blocks 50*a,b* and 52*a,b* are made of a suitable strength insulator material such as a linen phenolic.

Each pair of insulator blocks 50*a,b* and 52*a,b* establishes a corresponding recess therebetween which receives a rectangular electrically conductive shaper block 56 and 58, respectively. The shaper blocks 56 and 58 are substantially identical in configuration and are secured to their associated insulator plates 50 and 52 through suitable fastening means such as screws or the like, the insulator plates being affixed to the corresponding frame members 38 and 44 through suitable means such as mounting screws. The shaper blocks 56 and 58, which may be termed shaper halves, are made of an electrically conductive metallic material, such as berylium copper and have opposed generally planar surfaces 56*a* and 58*a* which lie in planes spaced slightly outwardly from corresponding the outer surfaces of the associated insulator blocks 50*a,b* and 52*a,b*.

The interfacing surfaces 56*a* and 58*a* on the shaper blocks 56 and 58 cooperate to define a pair of laterally spaced magnetic forming recesses which receive the cooperating telescoped ends of the work pieces 12 and 14 and establish an electromagnetic forming area about each of the telescoped end connections of the work pieces. To this end, the shaper blocks 56 and 58 define first recesses 56*b* and 58*b*, respectively, which are mutually cooperable to establish a first electromagnetic forming recess, and define second recesses 56*c* and 58*c* which are mutually cooperable to define a second electromagnetic forming recess when the shaper blocks are in their relative closed positions. FIG. 3 illustrates the configuration of the recesses 58*b* and 58*c* in the shaper block 58 which are also representative of and complementary, respectively, to the forming recesses 56*b* and 56*c* formed in the shaper block 56. The recesses 58*b* and 58*c* are symmetrical about a transverse center line of the rectangular shaper block 58 and each has a generally arcuate configuration, when considered in plan view as in FIG. 3, so that the axis of each recess 58*b,c* lies on a circle having a diameter substantially equal to the diameter of the connected work pieces 12 and 14. Each of the recesses 58*b,c* has generally semi-cylindrical lead-in or entry recess ends 60*a* and 60*b* which intersect the laterally opposite side surfaces of the associated shaper block and are interconnected by an arcuate generally semi-cylindrical smaller diameter recess 60*c*. Recess 60*c* is in turn intersected at its center length by a semi-spherical recess 60*d*.

As noted, the forming recesses 56*a,b* and 58*a,b* which are configured as the aforedescribed recess 58*b*, are complimentary so that when the shaper halves or blocks are supported by the frame members 38 and 44 in relatively closed positions, a pair of forming recesses are established each of which has entry or access ends defined by counter-bores 60*a,b* which provide access to the smaller diameter arcuate recesses 60*c* and corresponding spherical cavities defined by the complementary semi-spherical recesses 60*d*. The forming areas thus formed with the shaper blocks 56,58 in their closed positions are operative to substantially surround a work piece received therein. It will be appreciated that the forming recesses may take a number of alternative configurations in accordance with known electromagnetic forming techniques.

To assist in maintaining the movable shaper block 58 in vertical alignment with the upper shaper block 56 and with the surfaces 56*a* and 58*a* in parallel relation, the movable shaper block 58 preferably has a pair of guide blocks 68*a* and 68*b* secured thereon by suitable screws or the like as shown in FIG. 3. The guide blocks 68*a,b* have cylindrical bores 70*a* and 70*b*, respectively, formed therethrough to slidingly receive cylindrical guide rods 72*a* and 72*b* which are suitably supported by the upstanding frame members 34*b* and 36*d* so as to provide controlled guidance for shaper block 58.

In accordance with the present invention, the shaper blocks 56 and 58 are connected into a single turn coil for conducting electric current around the recesses 56*b,c* and 58*b,c* when the shaper blocks are in their closed positions and a pulse current is applied to the shaper blocks by the pulse power supply 30. With reference to FIG. 2, the right-hand ends of the shaper blocks 56 and 58 are electrically interconnected by suitable flexible leaf-type conductor elements 76*a* and 76*b* which are connected to the corresponding shaper blocks 56, 58 by connection plates 78*a,b* respectively, and associated screws. The outermost ends of conductor elements 76*a,b* are connected in conductive relation between connector plates 80*a* and 80*b*. The left-hand ends of the shaper blocks 56 and 58 are connected through similar connector plates 82*a* and 82*b* to the ends of relatively flat flexible leaf-type conductors 84*a* and 84*b* which have their opposite ends connected, respectively, to buss bars 90*a* and 90*b*.

To prevent electrical shorting between the conductive shaper blocks 56 and 58, the opposed surfaces 56*a*, 58*a* on the shaper blocks and the surfaces defining the forming recesses 56*b,c* and 58*b,c* have an insulating layer formed thereon. In the illustrated embodiment, this insulation layer preferably comprises a relatively thin layer or sheet of non-conductive material, indicated at 94*a* and 94*b*, such as an epoxy resin glass which is suitably secured to the interfacing shaper block surfaces. A similsar insulation layer is also provided on each of the opposed surfaces of the conductors 76*a,b* and 84*a,b* so as to prevent electrical shorting of the single turn coil defined by the shaper blocks and associated conductors.

The leaf-type conductors 84*a* and 84*b* are electrically connected to the buss bars 90*a,b*, respectively, by suitable clamping plates 98*a* and 98*b* and associated mounting screws (not shown). The buss bars 90*a,b* and associated clamping plates 98*a,b* are mounted on a swing frame which includes a pair of inverted L-shaped brackets, one of which is illustrated at 100 in FIG. 1. The swing frame is pivotally mounted on the beam frame member 40 for pivotal movement about a horizontal pivot pin 102 FIG. 1 located at the bottom of the L-shaped brackets. The buss bar 90*b* is secured on a base plate 104 on the swing frame, as by screws (not shown). The buss bars 90 *a,b* are releasably secured together by a pairs of clamping bars 106*a* and 106*b* and associated pairs of connecting bolts 108*a,b*, it being understood that the buss bars 90*a,b* are suitably electrically insulated from each other. The swing frame is selectively adjustable about its pivot axis through pivot pin 102 through a connecting rod 110 (FIG. 2) having threaded opposite ends received through a suitable opening 112 in the swing frame and an opening 114 through an angle 116 fixed transversely to the lower surface of frame member 44. Nuts are threaded onto the threaded ends of the connecting rod 110 and enable selective lengthening or shortening of the effective length of the connecting rod 110 and thereby to pivot the upper ends of the L-shaped brackets 100 about the pivot pin 102 in the lower ends of the brackets 100 to bring the upper ends closer to or farther from the shaper assemblies 22*a* and 22*b*. The buss bars 90*a,b* and associated conductors 84*a,b*, are connected to the pulse power supply 30 through conductors 118*a* and 118*b*, respectively. The pulse power supply 30 may be of conventional design and includes a capacitor bank, and suitable controls connected to the power cables 118*a,b*.

In the operation of the forming apparatus 10 thus far described, and assuming for purposes of explanation that the aforementioned work pieces 12 and 14 are to be swaged together after their opposite ends are positioned in telescoping relation, and that the actuating cylinder 26 is actuated to open the shaper block halves 56 and 58, the assembled work pieces are placed between the open shaper blocks so that the telescoped ends of the work pieces are received within the forming recesses 58*b,c* in the shaper block 58. Preferably, the ends of the work piece 14 which are to be inserted into tubular ends of the work piece 12 have diametrically opposed flat areas formed thereon which are received within the ends of the work piece 12.

After inserting the assembled work pieces between the shaper halves, the lower shaper block 58 is raised to a closed position relative to the upper shaper block 56 such that the telescoped ends of the work pieces are disposed within the cooperating recesses 56*b*, 58*b* and 56*c*, 58*c*. The pulse power supply 30 is then fired to discharge the capacitor bank in a manner to supply a high magnitude current pulse through the conductive shaper blocks 56 and 58 and around the work spaces defined by the complimentary recesses 56*b*, 58*b* and 56*c*, 58*c*. It will be appreciated that a positive potential is applied to one of the buss bars 90*a* and 90*b*, which will serve as the positive input terminal buss bar, and a negative potential is applied to the other buss bar. With the conductive work pieces positioned within the resulting pulsed magnetic field, a cuurent pulse is induced in the work pieces which interacts with the magnetic field to produce a force acting on the telescoped portions of the word pieces within forming recesses 56*b*, 58*b*, 56*c* and 58*c* so as to swage the cooperating ends of the work pieces in generally fixed relation.

FIGS. 8 and 9 disclose alternative embodiments of shaper coils, indicated generally at 120 and 122, respectfully, which may be employed in the aforedescribed electromagnetic forming apparatus 10 in place of the shaper blocks 56 and 58 and associated conductors 76*a,b* and 84*a,b*. With particular reference to FIG. 8, the shaper coil 120 includes electrically conductive shaper blocks 124 and 126 which are made of a size enabling them to be received, respectively, within the recesses defined between the aforedescribed pairs of insulator blocks 50*a,b* and 52*a,b*. The shaper blocks 124 and 126 have integral electrically conductive extensions 124*a* and 126*a* which are integrally connected at 128, the conductive extensions 124*a* and 126*a* being of sufficient flexibility to enable separation of the shaper blocks 124 and 126 while being maintained in substantially parallel relation. The opposite ends of the shaper blocks 124, 126 have integral flexible electrically conductive extensions 124*b* and 126*b*, respectively, which terminate at their outer ends in separate free end portions 124*c* and 126*c* adapted to be connected to the aforedescribed buss bars 90*a* and 90*b*, respectively.

The shaper blocks 124 and 126 have opposed generally planar surfaces 124*d* and 126*d*, respectively, in which are formed mutually cooperating or complimentary recesses 130*a*, 130*b*, and 132*a*, 132*b*. The recesses 130*a,b* and 132*a,b* are adapted for mutual cooperation so as to establish magnetic forming recesses similar to the aforedescribed recesses 56*c,d* and 58*c,d* in the shaper blocks 56 and 58. A suitable insulating layer is affixed on the opposed surfaces of the shaper blocks 124*d* and 126*d* and their associated conductive extensions 124*a–c* and 126*a–c* to prevent electrical shorting of the single turn coil defined by shaper 120.

The shaper 122 illustrated in FIG. 9 is somewhat similar to the shaper 120 in that it includes a pair of conductive shaper blocks or halves 138 and 140 which have opposed generally planar surfaces 138*d* and 140*d*, respectively, in which are formed mutually cooperable work receiving and magnetic forming recesses 138*a*, 138*b* and 140*a*, 140*b* which operate in the same manner as the aforedescribed work receiving recesses 56*b,c* and 58*b,c* in the upper and lower shaper halves assemblies 22*a* and 22*b* of FIG. 2. Shaper 122 includes flexible leaf-type conductors 142*a* and 142*b* which are connected to the right-hand ends of the shaper blocks 138 and 140, respectively, and are integrally conductively coupled at their opposite ends at 144. The opposite ends of the shaper halves 138, 140 have flexible leaf-type conductors 146*a* and 146*b* suitably connected thereto. The opposite free ends of the conductors 146*a,b* are adapted for connection to the buss bars 90*a,b* in similar fashion to the aforedescribed conductors 84*a,b*. It will be understood that a suitable insulating layer is applied to each of the opposed conductive surfaces of the shaper halves 138, 140 and associated conductors 142*a,b* and 146*a,b* to prevent electrical shorting of the single turn shaper coil 122. In other respects, the operation of the shaper coils 120 and 122 is substantially the same manner as the aforedescribed shaper assemblies 22*a* and 22*b*.

While preferred embodiments of the present invention have been illustrated and described, it will be understood that changes and modifications may be made therein without departing from the invention in its broader aspects. Various features of the invention are defined in the following claims.

What is claimed is:

1. Electromagnetic forming apparatus comprising in combination.

frame means including a pair of frame members mounted on the frame for movement relative to each other, a pair electrically conductive, elongated shaper halves, each supported by a frame member and each having at least one forming recess therein, actuator means for moving at least one of said frame members and the shaper half thereon between an open position to receive workpiece in said recesses and a closed position, a first pair of flexible conductors connected to first ends of each of said shaper halves and a second pair of flexible conductors connected to opposite second ends of the shaper halves, said second pair of flexible conductors being electrically continuously connected when said shaper halves are in their open and closed positions and cooperating with said first pair of flexible conductors to provide a continuous electrical circuit between the halves and to establish the single turn coil when the shaper halves are in the closed position, and means for connection to a pulse power supply and connected to the first ends of said flexible conductors so as to establish an electrically closed conductive circuit through the flexible conductors and shaper halves while in the open and closed positions to facilitate selective application of a power pulse to said single turn coil.

2. An apparatus in accordance with claim 1 including guide means for guiding at least one of the frame members for vertical reciprocal movement between an open position and closed position and in which said flexible conductors are disposed generally horizontally.

3. An apparatus in accordance with claim 2 in which said flexible conductors are leaf springs extending outwardly from opposite ends of said frame members, the outer ends of said second pair of leaf springs being connected to one another to provide a continuous electrical path therethrough.

4. An apparatus in accordance with claim 1 in which said flexible conductors are in the form of leaf spring conductors with the second ends of the flexible conductors being attached, said means for connection to the pulse power supply including bus bars connected to the first ends of the first pair of flexible conductors, and a pivotally mounted frame member for supporting said bus bars for movement with opening and closing of the frame members.

5. An apparatus in accordance with claim 1 in which said shaper halves each have a pair of forming recesses therein of arcuate configuration for joining together several arcuate workpieces into a single ring shaped workpiece.

* * * * *